United States Patent [19]

Coulter

[11] Patent Number: 4,575,055

[45] Date of Patent: Mar. 11, 1986

[54] CIRCULAR TRAVELING GRATE MACHINE

[75] Inventor: Stanley M. Coulter, Wexford, Pa.

[73] Assignee: Dravo Corporation, Pittsburgh, Pa.

[21] Appl. No.: 755,167

[22] Filed: Jul. 15, 1985

[51] Int. Cl.[4] ..... F27B 9/26

[52] U.S. Cl. ..... 266/159; 266/180; 432/137

[58] Field of Search ..... 266/159, 178, 179, 180; 432/137

[56] References Cited

U.S. PATENT DOCUMENTS 3,302,936 2/1967 Ban ..... 266/145

4,408,987 10/1983 Oyler ..... 266/179

*Primary Examiner*—Melvyn J. Andrews

*Attorney, Agent, or Firm*—Parmelee, Miller, Welsh & Kratz

[57] ABSTRACT

A circular traveling grate machine includes rotatable, inner and outer, rail mounted, side frame members forming the sidewalls of an annular hearth region therebetween. A plurality of individually tiltable pallets are positioned in the hearth region and are movable with the side frames along a circular pallet trackway which is positioned within the inner and outer rails of the side frames. A stationary hood is mounted above the hearth region carrying sealing flanges at its lateral edges which extend downwardly in a pair of liquid troughs carried by the rotatable side frames. A stationary windbox is situated below the pallets and is also sealed off by way of lower liquid seals coacting with the side frames. The pallets carry a pair of rotatable hanger brackets at the leading ends thereof which are latched to the undersides of the inner and outer side frames. The trailing ends of the pallets are supported by a pair of wheels which travel on rails in respective tunnel-like passages, isolated on either side of the hearth region by mechanical seals. The upper and lower liquid seals provide a process zone which is hermetically sealed around its perimeter from the atmosphere. Additional mechanical seals in the area of the discharge zone isolate the lower liquid seals and prevent undue turbulence therein due to pressure changes in the transitional area from the process zone to the discharge zone.

14 Claims, 7 Drawing Figures

CIRCULAR TRAVELING GRATE MACHINE

CROSS-REFERENCE TO RELATED APPLICATION

This application is related to my commonly owned application entitled "Pallet Construction For Traveling Grate Machine", Ser. No. 755,187 and filed concurrently herewith.

BACKGROUND OF THE INVENTION

The present invention relates generally to traveling grate machines and, more particularly to circular traveling grate machines for thermally treating a moving burden, wherein minimum gas leakage is a requirement.

Generally, traveling grate machines are relatively large and are usually designed to handle high tonnage rates of particulate materials in a variety of thermal processes, such as the coking or gasification of coal; heat hardening or prereduction of iron ore pellets; and the retorting of oil shale, to mention a few. The machines are characterized by a plurality of pallets having gas permeable grates, which are moveable along a trackway, supporting a burden through the various zones of the machine. In operation, the pallet grates are first charged with crushed, balled, pelletized or otherwise formed and sized particulate material, such as oil shale, coal, iron ore, or the like. This charged burden is moved slowly by the pallet grates along the trackway through the various process zones. Processes such as coking and oil shale retorting require inert atmospheres and/or atmospheres that contain small controlled amounts of oxygen. The reduction of metallic oxides generally requires an atmosphere containing combustible mixtures of reducing gases. In some of these processes it is necessary, from a safety standpoint, to prevent ambient air leakage in order to guard against uncontrolled burning and/or explosion dangers. Thus, it is necessary to minimize, in so far as possible, leakage of ambient air into (or process gases out of) the apparatus, and, to this end, some form of sealing means around the traveling grate is essential. It is also desirable to isolate the pallet wheels and frame supporting components of the machines from the intense heat of the process zone so as to prolong service life. It is further desirable to employ a pallet design which reliably and quickly discharges its burden. Further, the pallets should be capable of being removed from the machine easily and quickly in the event that maintenance or replacement is required, without the need for expensive down time or elaborate equipment.

Heretofore, various circular traveling grate machines have been proposed to improve the gas sealing ability of the device as well as to improve upon the pallet configuration, its structural supports and the maintenance thereof. Exemplary of such is the circular traveling grate machine disclosed in U.S. Pat. No. 4,408,987 in which the pallet wheels travel in an isolated tunnel chamber filled with an inert gas. This tunnel-like configuration necessarily poses a serious drawback regarding inspection and maintenance of the pallet and side frame wheels since these wheels are hidden from view around most of the machine. Gas sealing of the process zones is achieved through an upper pair of liquid seals and lower mechanical seals in conjunction with the aforementioned tunnels.

U.S. Pat. No. 3,302,936 discloses (in FIGS. 13–15, thereof) a circular traveling grate machine for removing oil from oil bearing shale in a retort process wherein the pallets carry a moving sidewall of the hearth on opposed sides thereof. The marginal edges of the sidewalls engage upper and lower water troughs for sealing purposes. The pallets have a central, third wheel which runs on a dump rail in the center of the pallet trackway and is, thus, continually exposed to excessive heat which necessarily leads to a relatively short work life of the third wheel and its supporting structure. In addition, the outer wheels of the pallet must not only carry the weight of the pallet and that of the burden but they also must support the weight of the vertical sidewalls of the hearth. This objectionable sidewall loading characteristic is also present in the above-discussed U.S. Pat. No. 4,408,987, which necessarily increases the wear factor on the pallet wheels, bearings, and related structural elements, causing increased maintenance and decreased service life.

The present invention solves many of the problems heretofore encountered in the construction, operation and maintenance of such devices by providing a circular traveling grate machine having upper and lower liquid seals which create a hermetically sealed environment in the process zones. The invention further provides for separate sets of load bearing wheels and trackways, a first set for the rotating side frame members of the hearth and a second set for the pallets. The wheeled trucks supporting the side frames are externally accessible for visual inspection and maintenance purposes. Still further, my invention provides a pallet construction which includes a pair of rotatable hanger brackets at the leading end thereof which detachably latch to the underside of the rotating inner and outer side frames. A fast-acting pallet release latch mechanism which permits easy removal of the pallet and replacement thereof is also provided. My invention further provides mechanical seals in the area of the discharge zone adjacent the lower liquid sealing troughs. These seals prevent a standing wave or water fall effect in the lower water seals along the discharge zone which is exposed to a differential in pressure from the process zone. The invention still further provides a plurality of motor assemblies with gear drives which are mounted at spaced intervals around the inner and outer side frames and rotatably engage gear racks integral with the side frames to rotate the side frames around the circular trackway. Each of the drive assemblies are pivoted about a vertical axis to accommodate thermal expansion while maintaining engagement with the gear rack. Also provided are a plurality of anchored, guide rollers which engage a ring-shaped rail, mounted on the inner side frame to maintain the circular concentricity of the traveling grate machine.

SUMMARY OF THE INVENTION

Briefly stated, the present invention is directed to a circular traveling grate machine which includes rotatable, ring shaped inner and outer side frame members, each of which is supported by a plurality of wheeled trucks that travel on a first circular trackway comprising a pair of inner and outer concentric rails which lie in a horizontal plane. The space between the sidewalls of the inner and outer side frame members defines an annular hearth region in which a plurality of individually adjacent and tiltable pallets with integral, gas permeable grates are provided. The pallets travel with the sidewalls of the side frame members along a second horizontal trackway which lies within the inner and outer rails of the first trackway. The traveling grate machine further includes gas confining chambers above and below the pallets.

The chamber above the pallets in the hearth region is enclosed by a stationary hood mounted above the hearth and pallet trackway. The chamber below the pallet trackway in gas communication with the hood is a stationary windbox having sidewalls which sealably engage with bottom lateral surfaces of the moving pallets. Process gases are directed either in an upflow or downflow mode through the gas permeable pallets and the burden thereon and are circulated to and from the hood and windbox by appropriate ducting, dampers and fans. The invention provides a pair of inner and outer, upper liquid seals around the hearth region, formed by flanges carried by the stationary hood on its lateral edges. The sealing flanges extend downwardly into a pair of liquid containing troughs carried on the upper edges of the inner and outer rotating side frames. A pair of lower liquid seals are each positioned between the trackway of the pallets and the inner and outer trackways of the side frames, respectively, to provide, in cooperation with the upper liquid seals, a hermetic seal around the periphery of the traveling grate machine. Mechanical seals are also provided above and below opposed lateral edges of the pallets, engaging abutting edges of the side frame members and the upper edges of the windbox, respectively. These mechanical seals isolate the pallet wheels within a tunnel-like closure surrounding the wheels so as to thermally shield and minimize gas leakage and also minimize the size of the gas handling system. Circumferential gas flow around these tunnel-like passage ways is minimized through the use of a plurality of baffle plates. Each pallet has a baffle plate extending outwardly from opposed sides thereof. Each of baffle plates of the pallets overlays a mating baffle plate attached to an adjacent side frame member to effectively close off the passages to circumferential gas flow.

Each of the pallets also carry a pair of hanger brackets upwardly extending from the front end thereof for attachment to the underside of the inner and outer side frame members. A latching tongue having an external rotatable shaft, pivotally engages each of the hanger brackets to permit quick disengagement of a damaged or otherwise worn pallet from the machine and easy replacement thereof. A pair of wheels are mounted at the trailing end of each pallet for rolling engagement with the horizontally disposed pallet trackway. In the discharge zone of the machine, the pallet trackway contains a downwardly sloping dump rail section which allows the rear of the pallets to tilt downwardly as they pivot about the hanger brackets in order to dump the processed or otherwise spent burden. The dumped pallets then travel along the upwardly sloping portion of the dump rail to again assume a normal horizontal alignment, whereupon a fresh burden is loaded thereon.

The invention still further includes a pair of mechanical seals between the upper edges of the stationary windbox sidewalls and the lower surfaces of the rotating of the inner and outer side frames, adjacent to the lower liquid seals in the area of the discharge zone. These mechanical seals prevent a standing wave or similar waterfall turbulence in the lower liquid sealing troughs as a result of the abrupt pressure change which is experienced in the transition from the process zone to the discharge zone. Also provided are a plurality of spaced apart drive motors having gears which engage a pair of ring-shaped gear racks mounted around the circumference of the inner and outer side frames. Each of these drive motors are pivotally mounted about a vertical axis to accomodate for any lateral movement caused by thermal expansion or contraction of the side frames. Concentricity of the side frame members of the traveling grate is maintained by a plurality of anchored guide rollers which engage a ring-shaped guide rail extending horizontally around the circumference of the inner side frame.

BRIEF DISCRIPTION OF THE DRAWINGS

The invention will be more fully understood by reference to the accompanying drawings, in which.

DETAILED DESCRIPTION OF THE INVENTION

Figure 1:
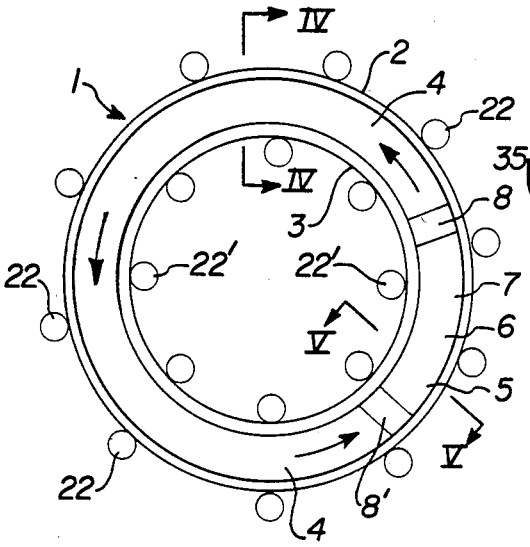
FIG. 1 is a schematic plan view of a circular traveling grate machine.

Referring now to the drawings, and particularly to FIG. 1, the circular traveling grate machine 1 comprises a ring shaped, outer side frame member 2 and a concentric inner side frame 3, which define an annular process zone 4 therebetween. The process zone 4 which may occupy approximately 340° of the circular structure of the machine, is transversely sealed at its charging end and at its discharge end by way of a pair of false windboxes 8 and 8', respectively. A burden of particulate material is continuously loaded on pallets 15 at a charging zone 7 and then conveyed through the process zone 4 in conventional fashion. After the thermal treatment steps have been completed, the spent, or otherwise processed, burden is dumped from the pallets in a discharge zone 5. Inspection, maintenance and replacement of the pallets takes place in a maintenance zone 6 which is positioned between the discharge zone 5 and the chargine zone 7, as schematically depicted in FIG. 1.

Figure 4:
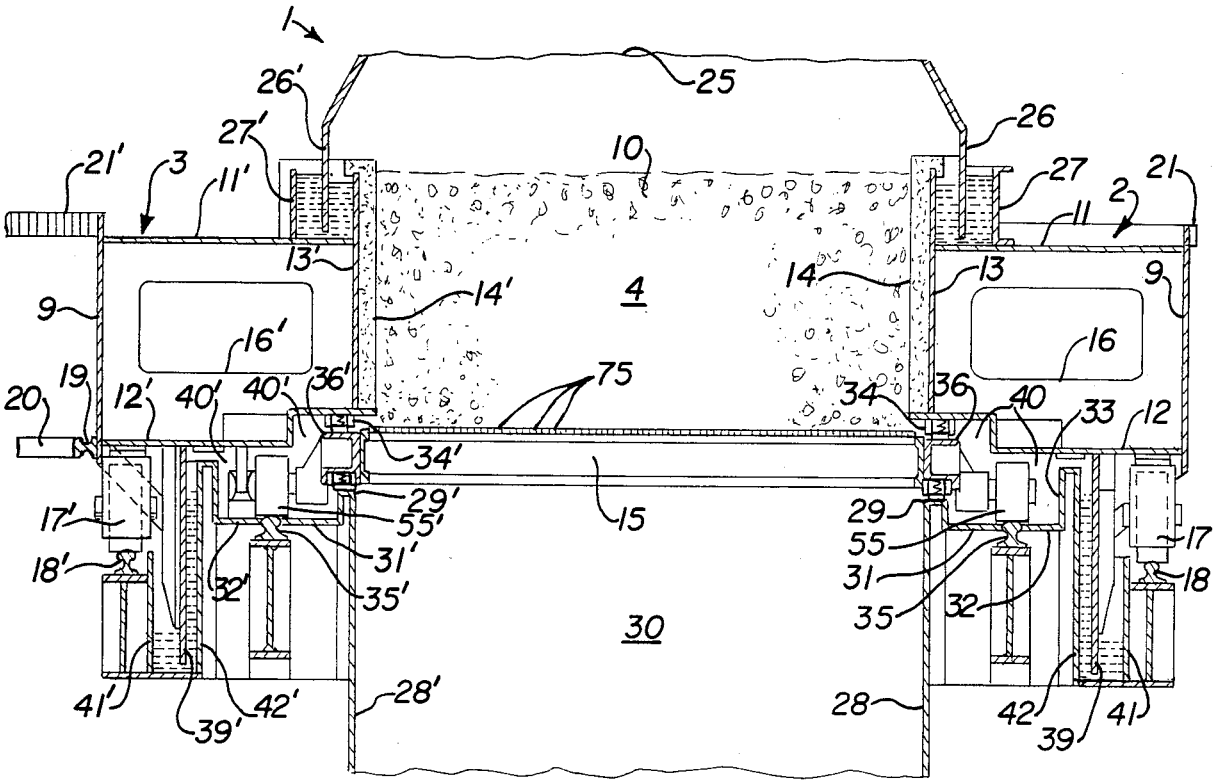
FIG. 4 is a transverse cross-section of the process zone of the traveling grate machine of the present invention, taken along line IV—IV of FIG. 1.
Figure 5:
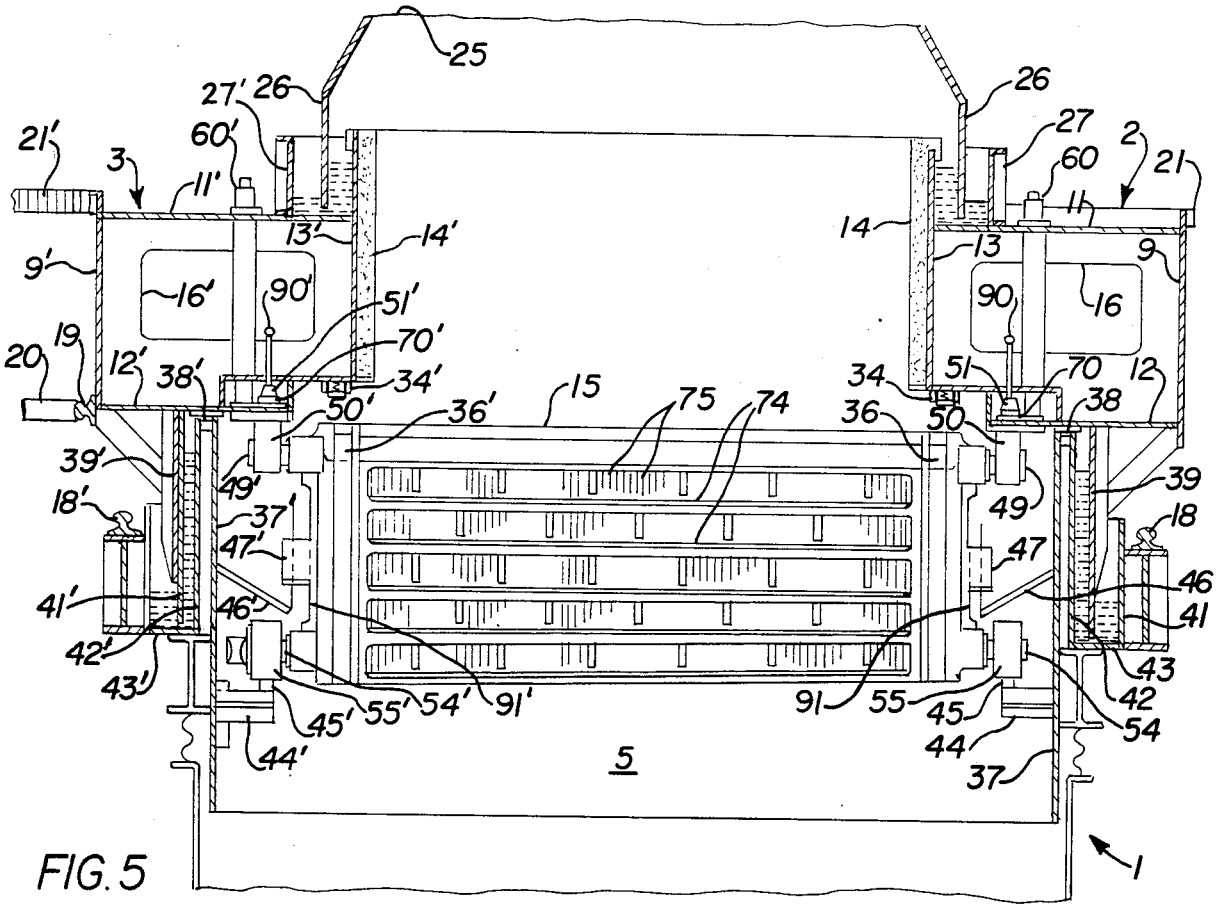
FIG. 5 is a transverse cross-sectional view of the discharge zone of the traveling grate machine, taken along the line V—V of FIG. 1.
Figure 6:
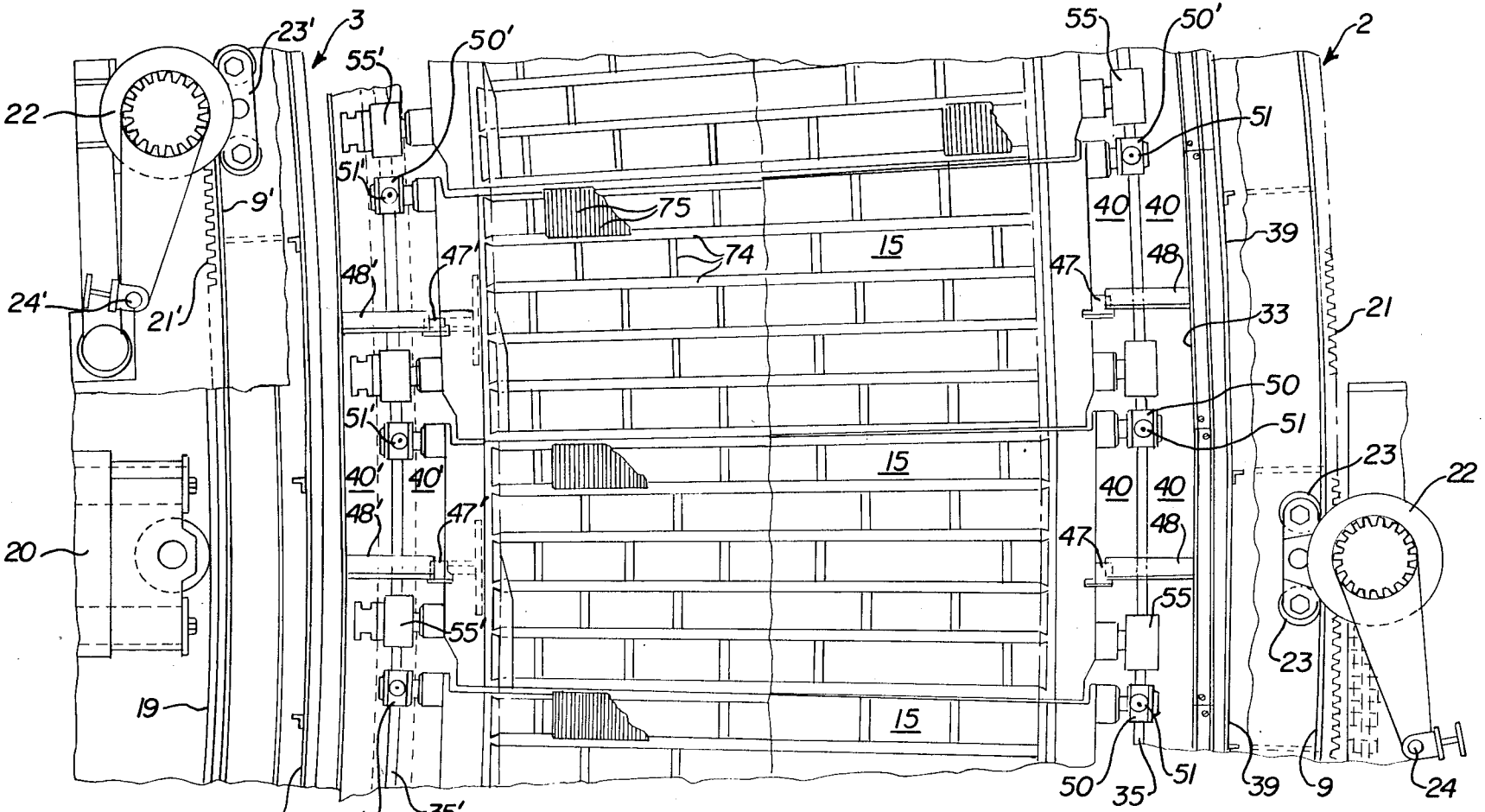
FIG. 6 is a partial plan view of the traveling grate machine showing several pallets with portions cut away.

Several of the details of construction of the traveling grate machine 1 of the present invention can best be understood with reference to FIGS. 4, 5 and 6. The traveling grate machine includes a plurality of individual pallets 15, having conventional spaced apart grate bars 75 which define a continuous, gas permeable grate surface within the confines of pallet frame 74. The pallets 15 move along a closed, circular trackway which will be described in greater detail hereinafter.

The machine 1 includes a rotatable, ring-shaped outer side frame member 2, comprising a continuous outer vertical sidewall 9 which is weldably attached to a horizontal upper surface plate 11 and a lower horizontal surface plate 12. A vertically disposed inner sidewall plate is secured to horizontal plates 11 and 12 and forms a continuous outer curved sidewall 13 of the hearth or process zone 4 of the machine. Sidewall 13 also carries an appropriate refractory lining 14 to thermally shield the steel plates from direct exposure to the hot gases which pass within the hearth region of the process zone 4. The outer side frame member 2 is rotatably supported on a plurality of spaced apart, wheeled truck members 17, which travel in a horizontal plane on an outer, circular rail 18.

Spaced concentrically inwardly from the outer side frame member 2 is an inner side frame member 3 which is constructed substantially the same as the outer side frame member 2. Similar structural elements contained in the inner side frame 3 are indicated by primed numbers in the drawings in order to indicate their correspondence with similar elements of the outer side frame member 2. As can be seen in FIG. 4, the inner side frame 3 is also rotatably mounted on a plurality of spaced apart wheeled trucks 17' which travel on a circular rail 18'. The inner rail 18' lies in a horizontal plane and is concentric with the outer rail 18 to form a first trackway for rotation of the ring-shaped side frame members thereon.

Vertical sidewall 13' of the inner side frame member 3 forms an inside sidewall of the process hearth and also has a refractory lining 14', attached thereto. Thus, sidewalls 13 and 13' of the rotatable outer and inner side frame members 2 and 3, respectively, define an annular hearth region of the process zone 4 therebetween. As depicted in FIG. 4, a burden 10 is supported on the pallets 15 within the process zone 4.

In order to maintain the concentricity of the rotating traveling grate 1, which may be affected by thermal gradients, a plurality of spaced-apart, spring loaded guide rollers 20 are employed to compressively engage a continuous guide rail 19 secured around the exterior periphery of the inner side frame member 3, on curved sidewall 9', FIGS. 4 and 6. Guide rollers 20 lie in a horizontal plane such that they each rotate about a vertical axis. The support mountings for the guide rollers 20 are individually anchored to a stationary foundation structure so as to resist the lateral forces imposed on the guide rollers.

The inner and outer side frame members 2 and 3 are moved along the rails 18, 18' of the first trackway by a plurality of motors 22 and 22' which are mounted on independent supports around the inner and outer circumference of the traveling grate machine in a spaced apart array. Continuous, ring-shaped gear racks 21 and 21' are mounted adjacent the tops of sidewalls 9 and 9' of the side frame members 2 and 3, respectively. The gear racks 21 and 21' are driven by meshing cylindrical gears carried by motors 22 and 22'. The driving gears are held in meshing engagement against gear racks 21 and 21' by the compressive action of wheeled bogey followers 23 and 23' which travel behind the gear racks on the reverse faces of plates 9 and 9', respectively, FIG. 6. In order to accommodate for any movement caused by thermal expansion and/or contraction which could result in variations in the concentricity of the gear racks on the sidewalls 9 and 9', each of the drive motors 22 and 22' are pivotally mounted about vertical shafts 24 and 24' which permits the motors to move radially with the gear racks, if necessary.

Figure 3:
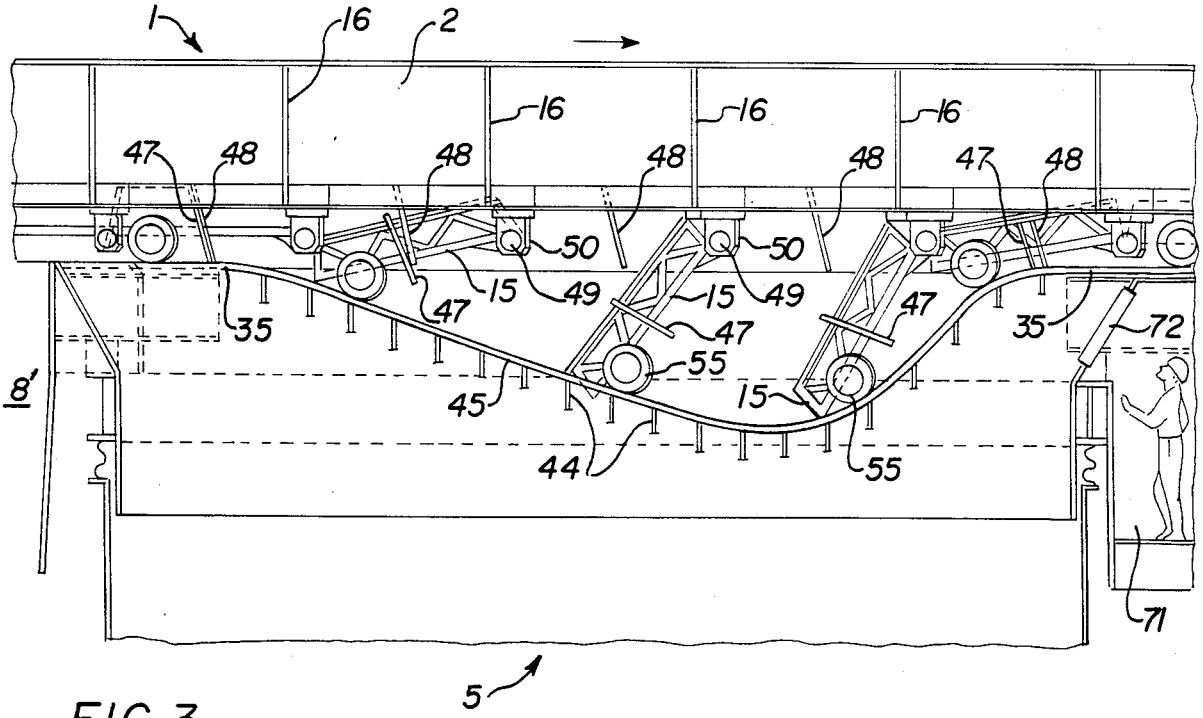
FIG. 3 is a partial side elevation of the discharge zone of a traveling grate machine incorporating another feature of the present invention.

The interiors of the outer and inner side frame members 2 and 3 are structurally reinforced by a plurality of transverse plate members 16 and 16', which are weldably secured at spaced apart intervals around the circumference thereof, FIG. 3. Transverse plates 16 are secured within the interior of the outer side frame members 2 between the upper and lower plates 11 and 12 and the outer and the inner wall plates 9 and 13. Transverse plates 16' are secured in similar fashion within side frame member 3.

Mounted above the process zone 4 and the pallets 15 is a gas confining chamber, comprising a hood 25. Situated below the pallets 15 is a conventional windbox 30, which is also a gas confining chamber and is enclosed by sidewalls 28 and 28', FIG. 4. The windbox 30 and the hood 25 are in fluid communication along the process zone 4 in a conventional manner. The hood 25 carries a pair of downwardly depending, stationary, arcuate sealing plates, having edges 26 and 26' which extend downwardly into a pair of concentric, rotating liquid troughs. An outer, upper liquid trough is formed by the side wall 13 of the side frame 2 and the vertical plate 27 which is attached to the upper plate 11 of the outer side frame 2. An upper liquid sealing trough of the inner side frame member 3 is formed in similar fashion by vertical plates 27' and 13' and horizontal plate 11'. In this manner, the upper portion of the hearth region 4 in hermetically sealed by way of the two upper liquid seals formed by the coaction of sealing plates 26 and 26' of the hood 25 and the liquid troughs at 27 and 27'.

The lower portion of the traveling grate machine 1 is, likewise, hermetically sealed by way of a pair of inner and outer, lower liquid seals which are concentrically positioned between the outer side frame rail 18 and the outer pallet rail 35 and the inner side frame 18' and the inner pallet rail 35'. The outer lower liquid seal trough is formed by vertical plates 41 and 42 which are stationary. The seal is completed by a rotating, arcuate sealing plate 39 which depends downwardly into the liquid trough from the lower surface of outer side frame member 2. Inner side frame member 3 is constructed in similar fashion and has a downwardly depending, arcuate sealing plate 39' which rotates in a stationary water sealing trough formed by vertical plates 41' and 42'. Thus, the upper liquid sealing troughs formed adjacent to plates 27 and 27' rotate about the stationary arcuate sealing plates 26, 26' of the roof 25 as the side frame members 2 and 3 rotate on wheeled truck members 17 and 17'. The wheeled trucks 17 and 17' are spaced outwardly from the lower liquid seals formed by the rotating arcuate plates 39 and 39', FIG. 4. Thus, the hearth region of the process zone is hermetically sealed by the aforesaid upper and lower liquid seals while the majority of the structural mass of the machine 1 is supported by external trucks 17 and 17'. It is noteworthy that, since these wheeled truck members are not exposed to the process heat, as is true in some prior art constructions, their service life is prolonged. It can also be appreciated that inspection and maintenance is simplified as a result of the accessibility of the trucks at the periphery of the respective side frames.

The pallets 15 and the supported burden 10 are pulled around the trackway rails 35, 35' by a pair of hanger brackets 50 and 50', which are latchably attached to the rotating outer and inner side frame members 2 and 3, respectively. As best seen in FIGS. 3 and 5, the pallets 15 are pivotally attached at their front or leading ends to the hanger brackets 50 and 50' by way of axles 49 and 49′ to permit the pallet to pivot about a transverse axis. A pair of laterally disposed pallet wheels 55 and 55′ are journaled to axles 54 and 54′, respectively at the trailing end of each of the pallets. In normal movement through the process zone 4, the pallets 15 would appear as depicted in FIGS. 4 and 6, traveling in a generally horizontal plane with the wheels 55 and 55′ supported on the second trackway defined by horizontal rails 35 and 35′.

The pallet wheels 55 and 55′ preferably travel in isolated, tunnel-like passages 40, 40′, respectively. The tunnel-like passage 40 is sealed-off from the hearth region of the process zone 4 and the windbox 30 by way of two mechanical seals 34 and 29. Passage 40′ is sealed off by mechanical seals 34′ and 29′ on the inner side of the traveling grate. Tunnel-like passage 40 is further enclosed by bottom plates 31 and 32 which abut the pallet track 35 and by vertical plate 33 which forms the outer wall of the closure. The upper surface of the passage way 40 is formed by bottom plate 12 of the outer side frame 2. The inner passage way 40′ is formed in the same manner as indicated by the corresponding structural elements 31′, 32′ and 33′. The mechanical seals 34 and 34′ are conventional and each comprise a high temperature metal sealing strip member, backed by a high temperature spring element, positioned at the lower edges of the side wall plates 13 and 13′ of the outer and inner side frame members, FIG. 4. The mechanical seals 34 and 34′ engage lateral top surface portions 36 and 36′ of the pallets 15 in a stationary, i.e., non-sliding, seal, due to the fact that the pallets 15 and the side frame members 2 and 3 rotate together. The mechanical seals 34, 34′ not only minimize gas leakage but they also minimize seepage of particulate material from the burden 10 into the passages 40, 40′ to prevent fouling of the pallet wheels or the rails 35, 35′. In addition, the spring loaded feature of the seals 34, 34′ provides a clearance gap between side frame members 2, 3 and the pallet surfaces 36, 36′ which prevents any harmful transmission of inadvertent loading forces from the side frames to the pallet wheels.

A pair of lower mechanical seals 29 and 29′, also of a high temperature metallic material, are positioned at the lower lateral edge surfaces of the pallets 15. Mechanical seals 29, 29′ compressively engage the upper edge portions of the windbox sidewalls 28 and 28′, respectively, in a sliding mode since the windbox sidewalls are stationary. As can be seen in FIG. 5, lower mechanical seals 29 and 29′ are not functional in the discharge zone 5, since the windbox sidewalls 28, 28′ are removed in zone 5 to permit the dumping of the pallets 15. Because the mechanical seals 29, 29′ and 34, 34′ effectively seal off the tunnel-like passages 40 and 40′, there is little or no process gas leakage to or from the process zone 4 or the windbox 30. Use of the tunnel-like passages 40, 40′ not only protects the pallet wheels and their bearings from direct impingement with the process gases, but, more importantly, permits the use of lower horsepower fans to permit the use of a more efficient and less costly air handling system.

While the mechanical seals 34, 34′ and 29, 29′ prevent radial gas leakage from the process zone 4 into the tunnel-like closures 40 and 40′, circumferential gas flow within and around the closures 40 and 40′, from the discharge zone 5 and from the loading zone 7, is minimized through the use of a plurality of baffle plates 47 and 48 which are transversely positioned across the closures 40 and 40′ and are shaped, in radial, cross-sectional view, to conform to the cross-section of the tunnel-like passages. As seen in FIGS. 3 and 6, each pallet 15 has a pair of outwardly extending baffle plates 47 and 47′ affixed on opposed lateral sides thereof. Baffle plates 47, 47′ lie against, inclined, side frame baffle plates 48 and 48′ which are welded or otherwise secured to the rotating outer and inner side frame members 2 and 3, respectively. The ends of the baffle plates 47 and 48 overlap one another, as do plates 47′ and 48′, FIG. 6, and, thus, accommodate for any radial movement therebetween to insure a suitable seal while they rotate together. As seen in FIG. 3, the baffle plates 47 of the pallet fall away from the baffle plates 48 of the side frames during the discharge operation and then are reunited after the dumping has been completed.

The pressure within the process zone 4 changes dramatically as a transition is made through the transverse sealing areas of the false windboxes 8, 8′ into the discharge zone 5. Because of this rapid pressure change and in order to prevent a possible standing wave or turbulent waterfall effect in the lower liquid seals 39 and 39′, a pair of mechanical seals 38 and 38′ are provided between the upper surfaces of the outer and inner sidewalls 37 and 37′ and the side frames 2 and 3 in the area of the discharge zone 5. Mechanical seals 38, 38′ are of the sliding type and are affixed to the upper horizontal surfaces of the stationary vertical sidewalls 37 and 37′ of the discharge hopper and compressively engage the rotating lower surfaces 12 and 12′ of the outer and inner side frames. The mechanical seals 38 and 38′ extend circumferentially between the two false windboxes 8, 8′ traversing the discharge zone 5, the maintenance zone 6 and the loading zone 7.

The loaded pallets 15 travel in a horizontal plane on the rails 35, 35′. When the pallets reach the discharge zone 5, the pallet wheels 55 and 55′ begin to descend along the depressed dump rail section comprising rails 45, 45′, as best seen in FIGS. 3 and 5. As the wheels 55, 55′ travel along the downwardly sloping rails 45, 45′, each pallet 15 tilts downwardly about a transverse axis of the pallet passing through the axles 49, 49′ of hanger brackets 50, 50′. When the pallets reach the lowermost portion of the dump rail section, the burden 10 is completely discharged therefrom by force of gravity. Continued rotation of the side frames 2 and 3 pulls the attached pallets 15 upwardly along the now ascending rails 45, 45′ to once again position the pallets in a horizontal mode on tracks 35, 35′ for subsequent loading of a fresh burden in zone 7.

Referring to FIG. 5, a pair of shield plates 46 and 46′ are provided and extend outwardly from the side walls 37 and 37′ of the discharge hopper. The shield plates 46, 46′ slope downwardly and are spaced in close relationship to the dump rails 45, 45′ and the pallet wheels, in order to protect the pallet wheels, wheel bearings and the rails from direct contact with the burden being dumped in zone 5.

In order to insure that pallets 15 and wheels 55, 55′ and other components are properly functioning, an inspection station 71 is provided to permit visual inspection through a window 72, FIG. 3. The inspection station 71 is preferably located at the end of the discharge zone 5 and may also include pallet grate cleaning means such as water sprays (not shown) prior to or in the maintenance zone 6. The pallets 15 travel past the inspection station 71, and enter the maintenance zone 6 wherein damaged or worn pallets may be removed from the traveling grate machine and replaced with a new or rebuilt pallet with minimum machine down time.

Figure 7:
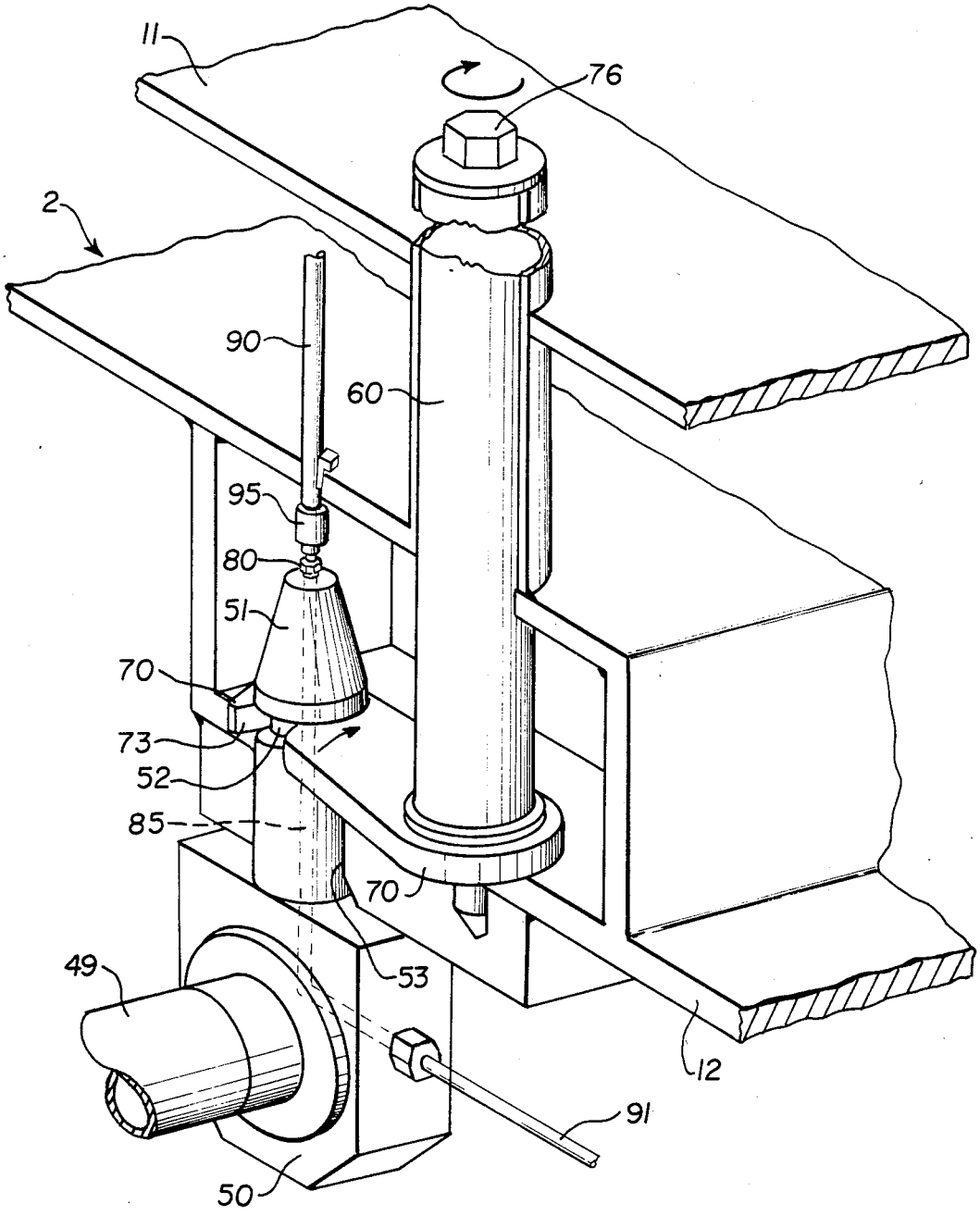
FIG. 7 is partial cut-away, perspective view of the pallet latching mechanism of the present invention.

Referring to FIGS. 5 and 7, lubrication is supplied to the bearings of the pallets 15 by way of lubrication conduit lines 90 and 90'. As best seen in FIG. 7, lubrication line 90 includes a male fitting 95 which detachably conventional female fitting 80 mounted at the end of a bore 85 formed in the hanger bracket 50. The bore 85 communicates with the race of the bearings around axle 49 to permit direct lubrication thereof. Additional lubrication conduit 91 may also extend from the hanger brackets 50, 50' rearwardly to the bearings of the pallet wheels 55, 55'.

Figure 2:
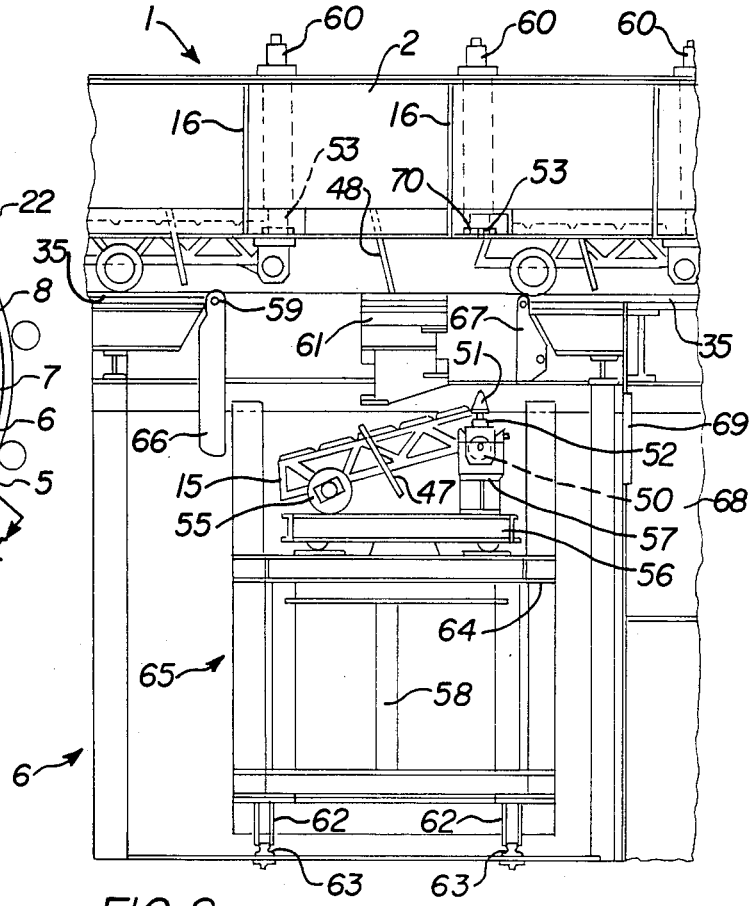
FIG. 2 is a partial side elevation of a portion of a traveling grate machine incorporating features of the present invention.

The pallet hanger brackets 50, 50' each have a pair of truncated cone-shaped head portions 51, 51' with a smaller diameter neck portion 52 adjacent thereto. As best seen in FIGS. 2, 5 and 7, the inner and outer side frame members 2 and 3 contain a plurality of pallet mounting receptacles 53 which receive the cone-shaped heads 51, 51' of the pallet hanger brackets therein. Upon insertion of the bracket heads 51, 51', a latching mechanism comprising a pallet latching shaft 60, having a latching tongue 70 with a notched portion 73, is rotated into engagement with the neck portion 52 of the hanger bracket. As can be seen in FIGS. 5 and 7, the pallet latching shafts 60, 60' have accessible end portions, which include wrench engagable nuts 76, which extend above the upper surface plates 11, 11' of the outer and inner side frames 2 and 3, respectively, adjacent each of the hanger brackets 50, 50'. In the event that it is necessary to remove a pallet from service, operating personnel manually or automatically rotate the shafts 60, 60' in order to disengage the latche tongues 70 from the hanger brackets and release the pallet therefrom.

The maintenance zone 6 also includes a transfer hoist car, generally designated 65, comprising a hoist frame 64 which includes a hydraulic lift mechanism 58 supporting a wheeled dolly 56. A raised alignment frame 57 engages the pallet hanger bracket 50 and closely aligns the cone-shaped heads 51, 51' with the mounting receptacles 53 of the side frame members. The transfer hoist car 65 includes supporting wheels 62 which ride on a pair of rails 63 for transport of the pallets 15 between the traveling grate machine 1 and a remote maintenance location. The pallet rails 35, 35' of the second trackway contain a first drop rail section 66 which is pivotally connected thereto by pins 59 a second drop rail section 67, which, in the closed position, engage a central, stationary rail section 61. In order to remove a damaged or worn pallet from the machine 1, the drop rail sections 66 and 67 are pivotally swung downwardly away from the rails 35, 35' to permit the grasping of the pallet by the frame 57 carried on the wheeled dolly 56. A replacement pallet may then be moved into place utilizing the transfer hoist car 65 and raised by way of the hydralic lift 58 into an aligned position relative to the mounting receptacles 53 for receipt of the hanger brackets 50. The replacement pallet is then seated and secured to the side frame members by rotation of latching shafts 60, 60' and the drop rails 66, and 67 are swung back into horizontal and locked alignment with the rails 35, 35'. The traveling grate machine is then ready for further operation, with a minimum of downtime expended. The maintenance zone 6 also includes an operator bay 68, provided with a window 69 to permit visual observation of the pallet release and insertion procedures, FIG. 2.

Located adjacent to and downstream from the maintenance zone 6 is the charging zone 7 which is conventional. The charging zone includes one or more dribble chutes for feeding particulate material onto the moving array of empty pallets 15 to form the fresh burden 10 thereon prior to entry into the process zone 4. As seen in FIG. 1, the discharge zone 5, maintenance zone 6 and charging zone 7 are sealed off from the process zone 4 by transverse seals formed by the false windboxes 8, 8'. The false windboxes include a pair of spaced-apart, transverse rows of conventional dead plate seals (not shown) which tiltably engage the bottom frames of the pallets 15 across the entire width of each pallet to prevent gas flow through the grates of the sealed pallet from or to the adjacent process zone. The dead plate seals are supported on the top edges of the false windbox in a conventional manner. The burden 10, due to the bed height, effectively seals off the area above the pallets downstream from the false windbox 8 to minimize circumferential gas leakage to or from the process zone 4.

Having described my invention, what is claimed is:

1. A circular traveling grate machine comprising:

a first circular trackway having inner and outer concentric rails;

ring-shaped inner and outer side frame members each having wheeled support means movable on the inner and outer rails, respectively, of said first trackway;

drive means for moving the side frame members along said first trackway;

a second circular trackway having a pair of rails positioned within the annular region defined by the rails of the first trackway;

a plurality of gas permeable pallets, each having a pair of laterally disposed wheels for travel along said second trackway, said pallets having spaced-apart grate elements for supporting a burden thereon;

coupling means connecting said pallets to each of the side frame members to enable the pallets to travel with said side frame members whereby the weight of the side frame members is carried by the wheeled support means on the first trackway and the weight of the pallets and the burden is supported by the pairs of pallet wheels on the second trackway;

stationary gas confining hood means positioned above the pallets and the second trackway;

stationary gas confining windbox means having spaced-apart sidewalls positioned below the pallets and the second trackway, a portion of the windbox means being in fluid communication with said hood means and defining a process zone along said communicating portion;

upper liquid sealing means circumferentially coacting between the hood means and the inner and outer side frame members; and lower liquid sealing means circumferentially coacting between the windbox means and the inner and outer side frame members and disposed between adjacent rails of the first and second trackways, whereby said process zone is hermetically sealed from the ambient atmosphere around its inner and outer peripheries.

2. The circular traveling grate machine of claim 1 wherein said pallets include lateral edge portions having upper and lower surfaces therealong;

upper mechanical sealing means coacting between the inner and outer side frame members and the upper surfaces of the lateral edge portions of the pallets; and lower mechanical sealing means coacting between the sidewalls of the windbox means and the lower surfaces of the lateral edge portions of said pallets, whereby the pallet wheels and the rails of the second trackway are isolated from the process zone by said upper and lower mechanical sealing means.

3. The circular traveling grate machine of claim 2 including structural plate means forming tunnel-like passages around the pallet wheels and the rails of the second trackway, said passages laterally positioned on opposed sides of said pallets extending from said upper and lower mechanical sealing means to the lower liquid sealing means and extending circumferentially around the process zone of the traveling grate machine.

4. The circular traveling grate machine of claim 3 wherein each of the pallets include a pair of baffle plate means affixed to opposed lateral sides thereof, outwardly extending transversely into the tunnel-like passages and a plurality of spaced-apart side frame baffle plate means secured to the inner and outer side frame members for overlapping engagement with each of the baffle plate means of the pallets to transversely seal-off the tunnel-like passages around the pallet wheels from substantial circumferential gas flow.

5. The circular traveling grate machine of claim 1 including a charging zone and a discharge zone, and a maintenance zone located between said charging and discharge zones, including means in said maintenance zone to permit visual inspection of the pallets and also including means for removal and replacement of pallets in the traveling grate machine.

6. The circular traveling grate machine of claim 1 including a charging zone and a discharge zone, and gas sealing means including false windboxes transversely positioned between the process zone and the discharge zone and between the charging zone and the process zone, said traveling grate machine further including mechanical sealing means in the area of the discharge zone coacting between the inner and outer side frame members and a pair of fixed horizontal surfaces carried by vertical sidewalls of a discharge hopper and spaced beneath said inner and outer side frame members to isolate the lower liquid sealing means from pressure variations adjacent the discharge zone, whereby turbulence in the liquid sealing means is minimized.

7. The circular traveling grate machine of claim 1 wherein the coupling means for connecting the pallets to each of the side frame members comprises a pair of laterally disposed hanger brackets pivotally attached to a leading end of each of the pallets to permit each pallet to tilt about a transverse axis thereof, latching means associated with said inner and outer side frame members for securing said respective hanger brackets thereto and wherein said second trackway includes a depressed dump rail section in the discharge zone, whereby, as each of the pallets is moved by the rotating inner and outer side frame members through the discharge zone, the pallet wheels descend along said dump rail section causing the pallets to pivot about the hanger brackets and tilt downwardly to permit gravity discharge of a processed burden therefrom, further movement of said pallet wheels in an ascending direction along the dump rail section causing said pallets to tilt upwardly to assume a horizontal alignment prior to entry into the charging zone.

8. The circular traveling grate machine of claim 7 including a pair of shield plate means positioned in the discharge zone in spaced relationship to the dip rails whereby the pallet wheels and the dip rails are protected from contact with the burden being dumped from the pallets.

9. The circular traveling grate machine of claim 7 wherein the latching means for securing the pallet hanger brackets comprises a plurality of spaced-apart latching shafts rotatably mounted on the inner and outer side frame members and positioned adjacent the hanger brackets, each of said latching shafts carrying a notched latching tongue which lockably engages a neck portion of each of said hanger brackets when said latching shaft is rotated into a first position and which releases said hanger bracket when the latching shaft is rotated into a second position to permit the removal and replacement of pallets in the traveling grate machine.

10. The circular traveling grate machine of claim 7 further comprising a maintenance zone positioned between the discharge zone and the loading zone, said maintenance zone including drop rail means on the second trackway and transfer hoist car means moveably aligned beneath said drop rail means to permit the removal and replacement of pallets on said second trackway.

11. The circular traveling grate machine of claim 10 wherein the transfer hoist car means includes means for supporting a pallet thereon and for aligning the pallet hanger brackets with the latching means of the inner and outer side frame members and further including hydraulic means for lifting and lowering an aligned pallet to and from said machine.

12. The circular traveling grate machine of claim 1 wherein the drive means comprises a plurality of spaced-apart gear motors mounted around exterior peripheries of the inner and outer side frame members, said side frame members each carrying a ring-shaped gear rack around the exterior periphery to mesh with the gears of the motors.

13. The circular traveling grate machine of claim 12 wherein each of said gear motors is pivotally mounted about a vertical axis and each includes a wheeled bogey follower means whereby the gears of the motors compressively mesh with the gear rack to accommodate for radial variations in the concentricity of the respective gear racks.

14. The circular traveling grate machine of claim 12 further comprising continuous guide rail means secured around the periphery of the inner side frame member and a plurality of spaced-apart guide roller means engaging said guide rail means to maintain concentricity of the machine.

* * * * *